US006530186B2

(12) United States Patent
Torstensen

(10) Patent No.: US 6,530,186 B2
(45) Date of Patent: Mar. 11, 2003

(54) DOOR FRAMING APPARATUS AND METHOD OF USE

(76) Inventor: Eiler Torstensen, 4403-209 Street NW., Edmonton, Alberta (CA), T6M 2P3

( * ) Notice: Subject to any disclaimer, the term of this patent is extended or adjusted under 35 U.S.C. 154(b) by 0 days.

(21) Appl. No.: 09/813,057

(22) Filed: Mar. 20, 2001

(65) Prior Publication Data

US 2002/0134463 A1 Sep. 26, 2002

(51) Int. Cl.[7] ..... E06B 1/04

(52) U.S. Cl. ..... 52/217; 52/127.2; 52/213; 33/194; 33/197; 248/354.1

(58) Field of Search ..... 52/211, 212, 213, 52/217, 127.2, 127.4, 204.1, 656.4; 33/194, 197, 404, 562, 667, 749.1; 248/354.1, 354.3, 351; 49/504

(56) References Cited

U.S. PATENT DOCUMENTS 1,946,961 A * 2/1934 Blade
2,771,688 A * 11/1956 Baker
2,867,911 A * 1/1959 Atkinson
3,027,686 A * 4/1962 Oates
3,168,305 A * 2/1965 Lee
3,851,868 A * 12/1974 Lagasse ..... 33/194
4,707,925 A 11/1987 Englehart
4,829,727 A 5/1989 Kuzara, Jr.
5,025,607 A 6/1991 Green et al.
5,167,073 A 12/1992 Stein
5,253,839 A * 10/1993 McClure ..... 248/354.1
5,560,112 A 10/1996 Stein et al.
5,692,312 A 12/1997 Coeyman, Jr.
5,845,439 A 12/1998 Hendley
6,237,233 B1 * 5/2001 Cloutier et al. ..... 33/194
6,282,852 B1 * 9/2001 Walcker ..... 52/212

* cited by examiner

*Primary Examiner*—Yvonne M. Horton
(74) *Attorney, Agent, or Firm*—Henderson & Sturm LLP

(57) ABSTRACT

A method and apparatus 10 for installing and trimming a plurality of wooden mounting blocks 110 within a roughed out door frame 100 to prepare the roughed out door frame to 100 to receive a finished door frame: wherein, the apparatus 10 includes a pair of vertical standard units 11 11' connected together by a pair of horizontally adjustable spreader units 12 12' that are adapted to cooperate with one another to conform to the outside dimensions of the finished door frame; wherein, each of the vertical standard units 11 11' is provided with a plurality of router templates 27 and means for plumbing each vertical standard unit relative to one of the vertical studs 101 101' in the roughed out door frame 100; such that the wooden mounting blocks 110 can be glued to the vertical studs 101 101' and then trimmed using the router templates 27 so that the trimmed mounting blocks 110 are perfectly aligned to receive the finished door frame.

20 Claims, 7 Drawing Sheets

DOOR FRAMING APPARATUS AND METHOD OF USE

BACKGROUND OF THE INVENTION

1. Field of the Invention

The present invention relates to the field of door framing devices in general and in particular to a door framing template having upper and lower adjustable spreader members.

2. Description of Related Art

As can be seen by reference to the following U.S. Pat. Nos. 5,167,073; 4,829,727; 4,707,925; 5,560,112 and 5,025,607 the prior art is replete with myriad and diverse door frame installing methods and apparatus.

While all of the aforementioned prior art constructions are more than adequate for the basic purpose and function for which they have been specifically designed, they are uniformly deficient with respect to their failure to provide a simple, efficient, and practical method and apparatus for preparing a roughed out door frame to receive a finished door frame.

As most carpenters and homebuilders in general are all too well aware, the installation of a finished door frame within a roughed out door frame is normally a very labor intensive and time consuming task that adds an appreciable expense to the cost of building a new home.

As a consequence of the foregoing situation, there has existed a longstanding need among carpenters and the like for a new and improved method and apparatus for framing doors quickly, easily and inexpensively and the provision of such a method and apparatus is the stated objective of the present invention.

BRIEF SUMMARY OF THE INVENTION

Briefly stated, the door framing apparatus that forms the basis of the present invention comprises a pair of vertical standard units that are connected together by a pair of horizontally adjustable spreader units wherein the vertical standard units and the horizontally adjustable spreader units are adapted to conform to the dimensions of a finished door frame.

As will be explained in greater detail further on in the specification, each of the vertical standard units is provided with a plurality of vertically spaced router templates and means for plumbing and spacing as desired each vertical standard unit within the roughed out door frame wherein the spreader units are adapted to engage bearing plates provided on the vertical standard units such that the spacing between the vertical standard units are the same as the width of the finished door.

Once the door framing apparatus is properly installed within the roughed out door frame, wooden mounting blocks are secured to the vertical studs are subjected to a router which extends through the router template opening such that the router bit depth is set to the thickness of the finish frame material plus the desired margin.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
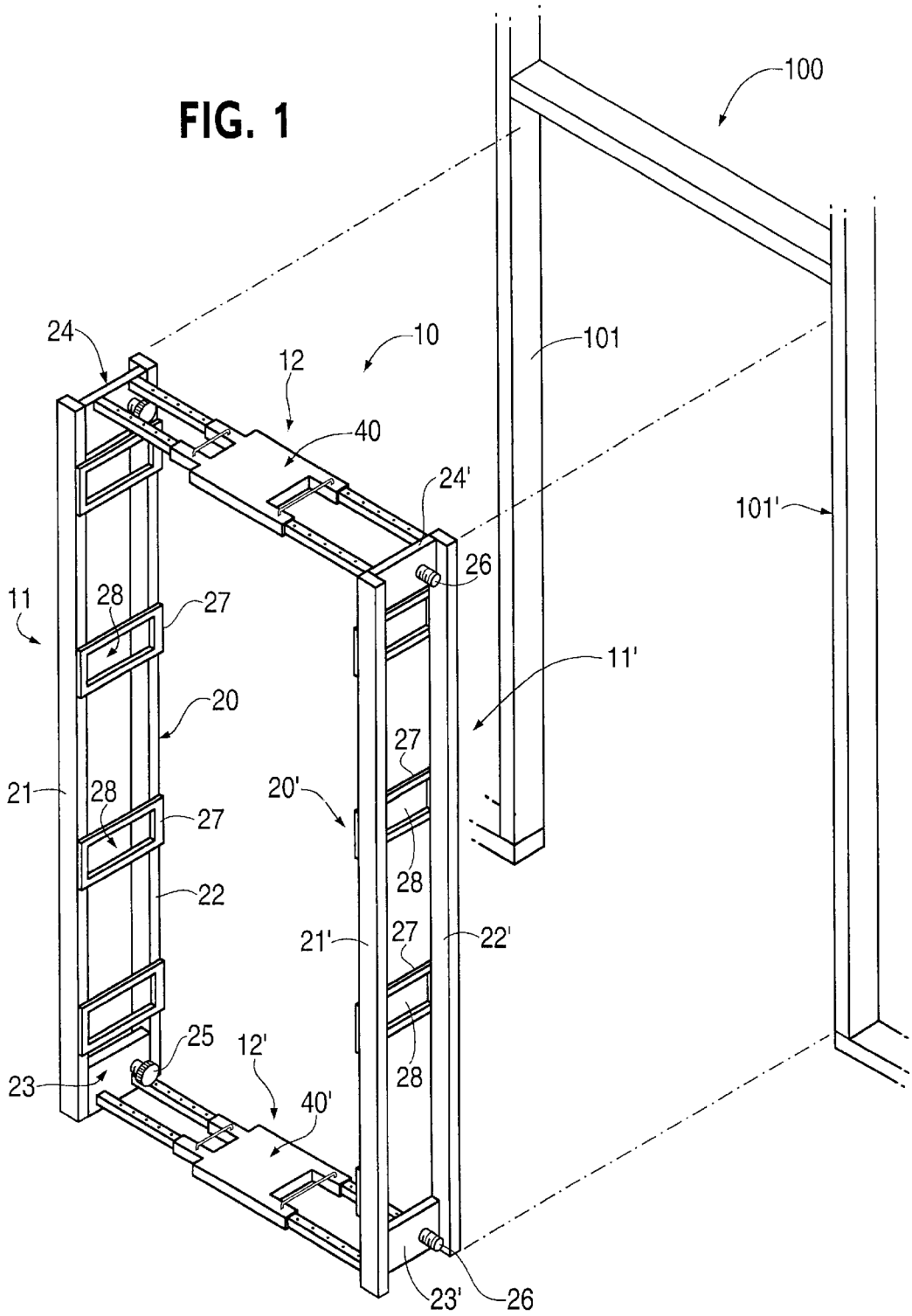
FIG. 1 is an exploded perspective view of the engagement between the door framing apparatus and a door frame.

As can be seen by reference to the drawings, and in particular to FIG. 1, the door framing apparatus that forms the basis of the present invention is designated generally by the reference number 10. The apparatus 10 comprises in general a pair of vertical standard units 11 11' and a pair of adjustable horizontal spreader units 12 12'. These units will now be described in seriatim fashion.

As can be seen by reference to FIG. 1, each of the vertical standard units 11 or 11' comprise an elongated rectangular vertical framework member 20 having a pair of vertical support legs 21 22 connected to one another by a lower horizontal bearing plates 23 and an upper horizontal bearing plates 24 wherein each of the bearing plates 23 24 is provided with an adjustment knob member 25 having a threaded stem 26 which extends outwardly relative to a complimentary threaded aperture formed in each of the bearing plates 23 24.

In addition, each pair of vertical support legs 21 22 is further provided with a plurality of vertically spaced and fixedly secured framed router templates 27 having enlarged central openings 28 whose purpose and function will be described in greater detail further on in the specification.

Figure 2:
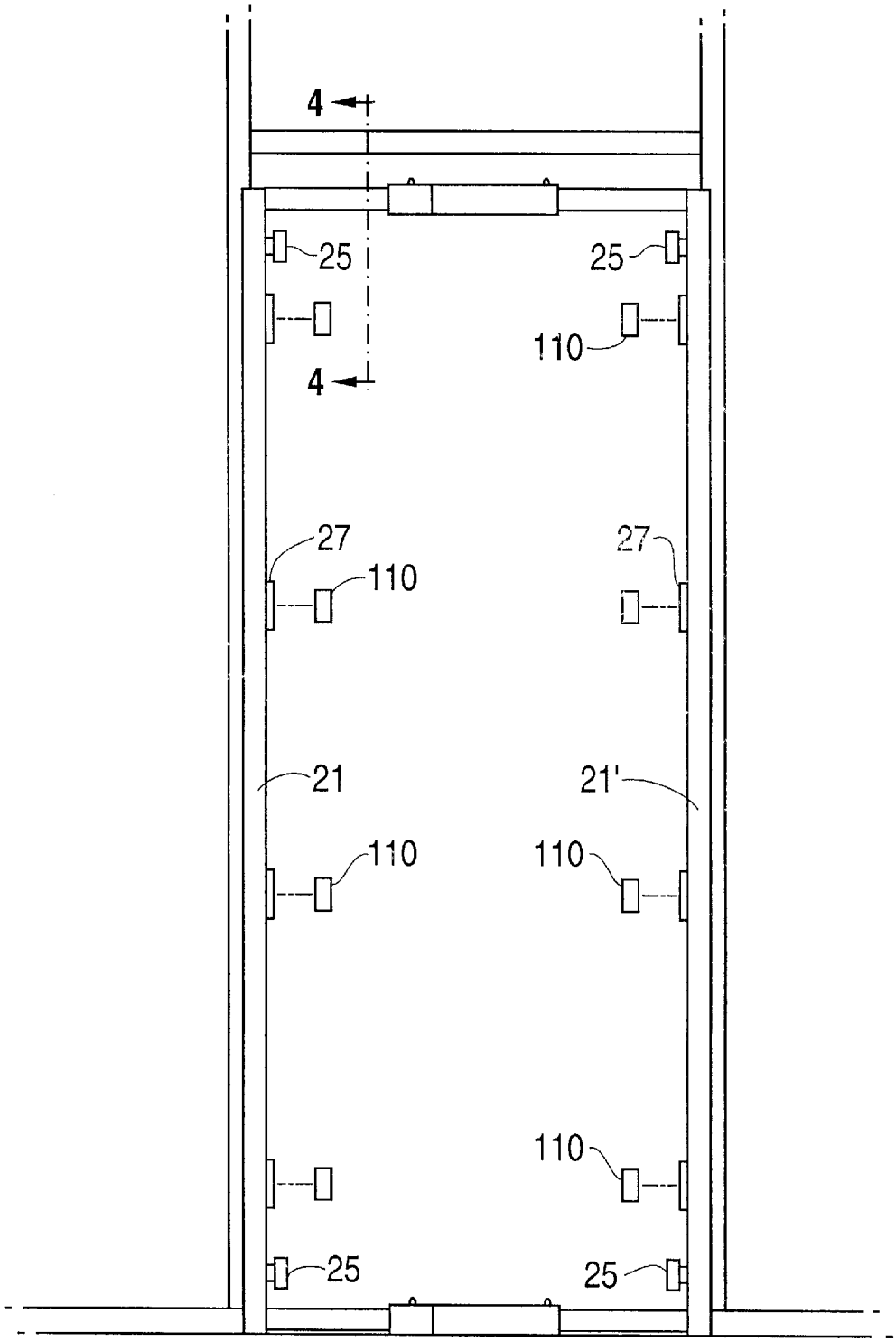
FIG. 2 is a front elevation view of the apparatus installed in a door frame.

As shown in FIGS. 1 and 2, the horizontal spreader units 12 12' comprise an upper horizontal spreader unit 12 and a lower horizontal spreader unit 12' wherein each horizontal spreader unit 12 12' comprises a generally H-shaped hollow spreader housing member 40 having a pair of widely spaced spreader channel arms 41 41 which project outwardly from one end 42 of the housing member 40, and a pair of more narrowly spaced spreader channel arms 43 43 which project outwardly from the other end 44 of the housing member wherein all of the spreader channel arms 41 41 43 43 are provided with a plurality of spaced apertures 45 whose purpose and function will be described in greater detail further on in the specification.

Figure 3:
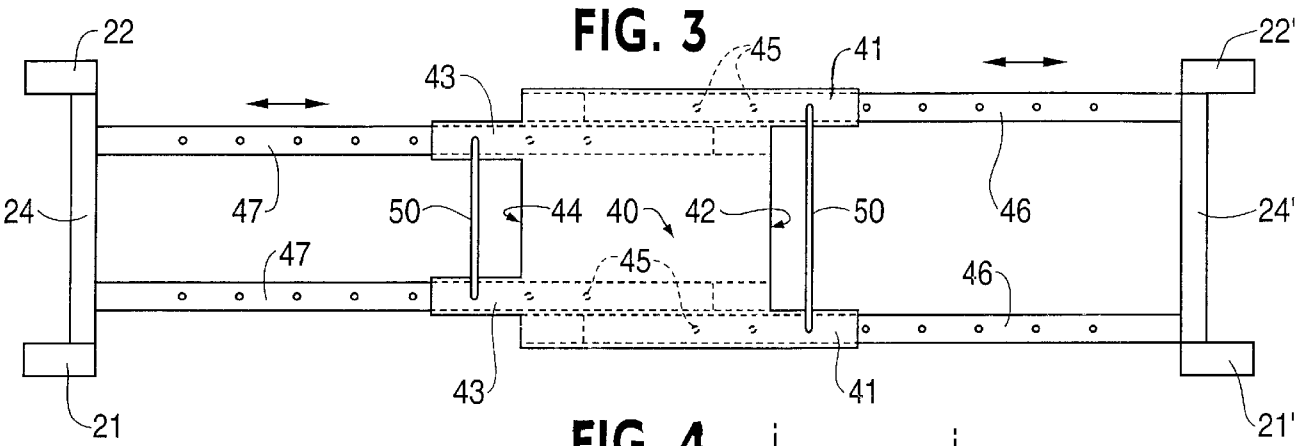
FIG. 3 is an isolated top plan view of one of the adjustable horizontal spreader units.
Figure 4:
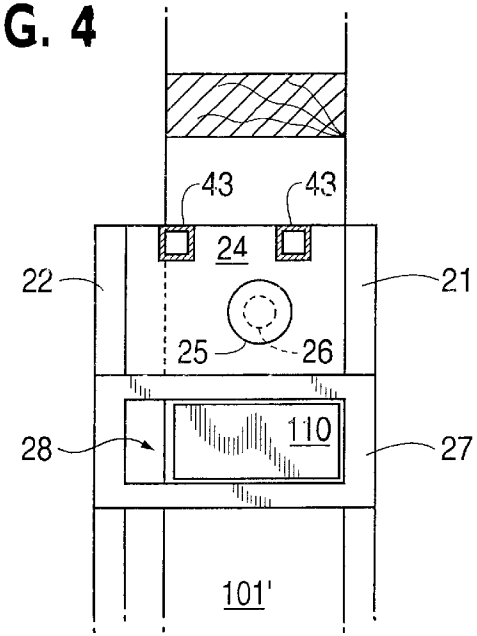
FIG. 4 is an isolated detail view of the upper portion of one of the vertical standard units.

In addition, as can best be seen by reference to FIG. 3, each pair of the hollow spreader channel arms 41 41 43 43 is dimensioned to slidably receive a complimentary pair of apertured spacer arm elements 46 46 and 47 47 respectively; wherein, the outboard end of each of the spacer arm elements 46 46 and 47 47 is fixedly secured in an opposed pair of bearing plates 24 24' or 23 23'.

Still referring to FIG. 3, it can be seen that the effective length of each of the horizontal spreader units 12 12 may be varied by registering the apertured spacer arm elements 46 46 47 47 with selected apertures 45 in the spacer housing member 40 and captively engaging the spacer arm elements therein via a pair of appropriately sized clips 50 whose opposite ends are dimensioned to be received in the aligned apertures in a well recognized fashion.

As can be seen by reference to FIGS. 1 through 4, the framing apparatus 10 is designed to be used with a roughed out door frame to prepare the roughed out frame 100 to accept a finished door frame.

Once the dimensions of a finished door frame are known, the apparatus 10 is then installed within the roughed out frame 100 and the upper length of the 12 and lower 12' horizontal spreader units are adjusted to force the vertical standard units 11 and 11' apart a desired distance.

At this juncture, the adjustment knobs 25 are manipulated to plumb the vertical framework members 20 20' relative to the vertical studs 101 101' within the roughed out frame 100. Then a plurality of wooden mounting blocks 110 are inserted through the openings 28 in the plurality of router templates 27 and secured to the vertical studs 101 101' by adhesives.

Figure 5:
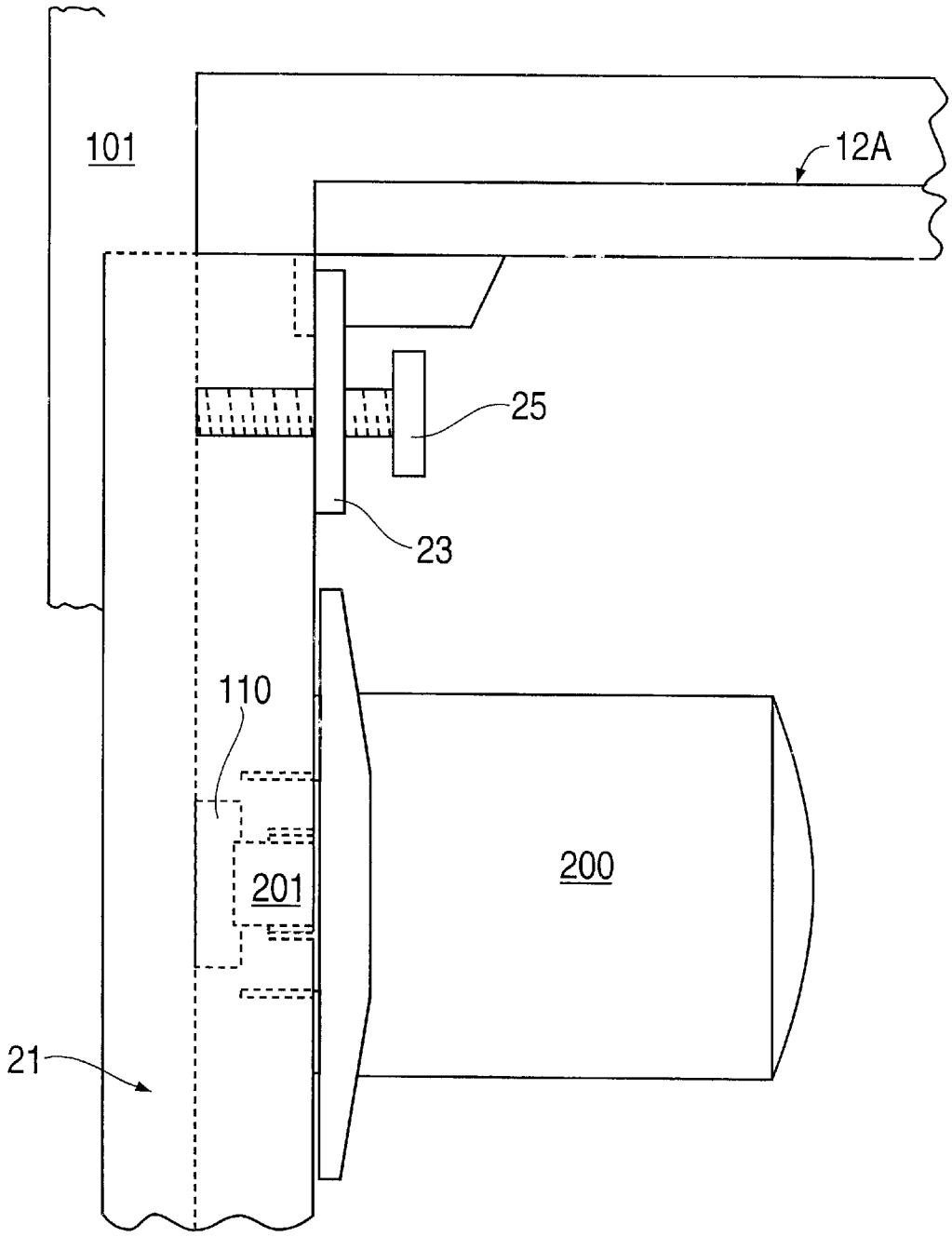
FIG. 5 is an isolated detail view of a router engaged with the router template guide and a wooden mounting block disposed in the rough opening.

As shown in FIG. 5, once the mounting blocks 110 are fixedly secured to the vertical studs 101 101', a router 200 is used to trim the mounting blocks 110 such that the trimmed mounting blocks 110 are now properly aligned to provide anchor points for securing a finished door frame within the roughed out frame 100 in a well recognized fashion.

Figure 7:
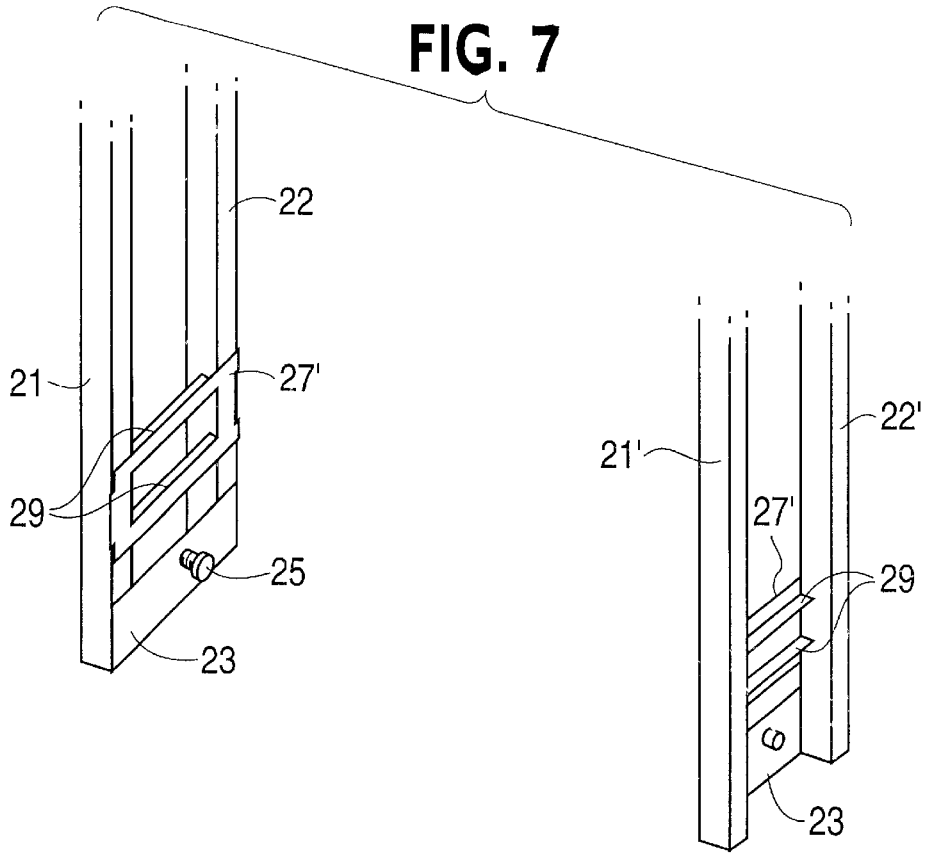
FIG. 7 is an isolated front and rear view of the router templates disposed on the oppositely faced vertical standards.

Turning now to FIG. 7, it can be seen that the fixedly secured router templates 27 may also be provided with inwardly directed lip portions 29 which are employed as a sizing guide to assist in the selection of a wooden mounting block 110 having the proper thickness to minimize the amount of material that will have to be trimmed from the mounting block 110 by the router bit.

Figure 6:
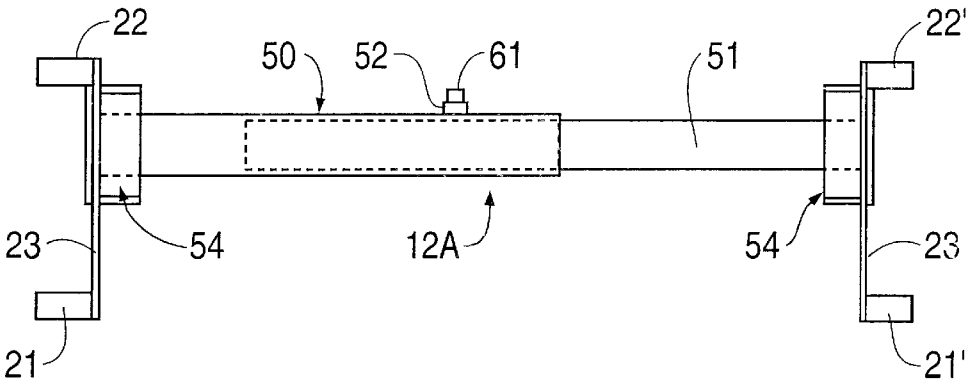
FIG. 6 is a top plan view of an alternate version of the spreader bar units.
Figure 8:
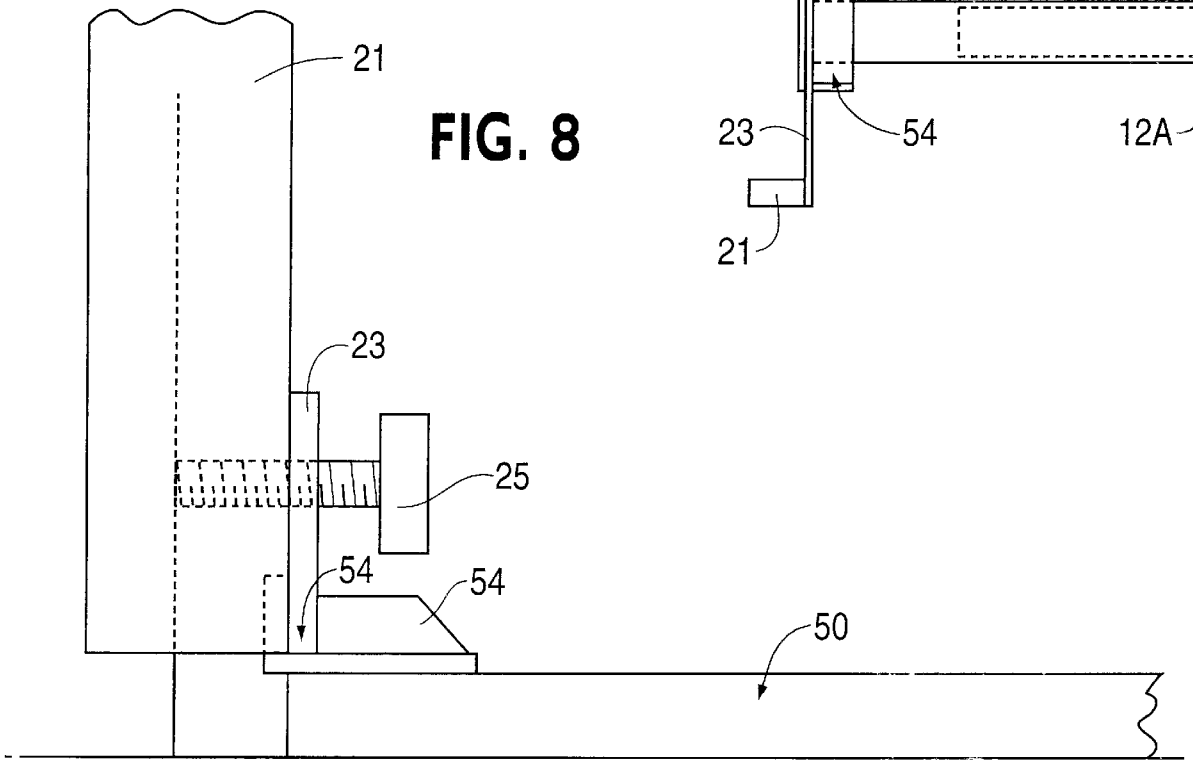
FIG. 8 is an enlarged detail view of the bottom corner of the door framing apparatus showing the engagement of the alternate version one of the spreader bar units engaged with the bottom of one of the vertical standards.

As can best be seen by reference to FIGS. 6 and 8, this invention also contemplates an alternate version of the horizontal spreader units designated simply as 12A wherein each horizontal spreader unit 12A includes a pair of hollow tubular spreader support arm members 50 and 51 including an inner spreader support arm member 51 slideably received within an outer spreader support arm member 50 wherein the inboard portion of the inner spreader support arm member 51 is provided with a plurality of alignable apertures.

In addition, the outboard ends of each of the spreader support arm members 50 51 are further provided with an attachment bracket element 54 provided with a transverse slot 55 that is adapted to receive a portion of the bearing plates 23 24 in a well recognized manner.

Figure 11:
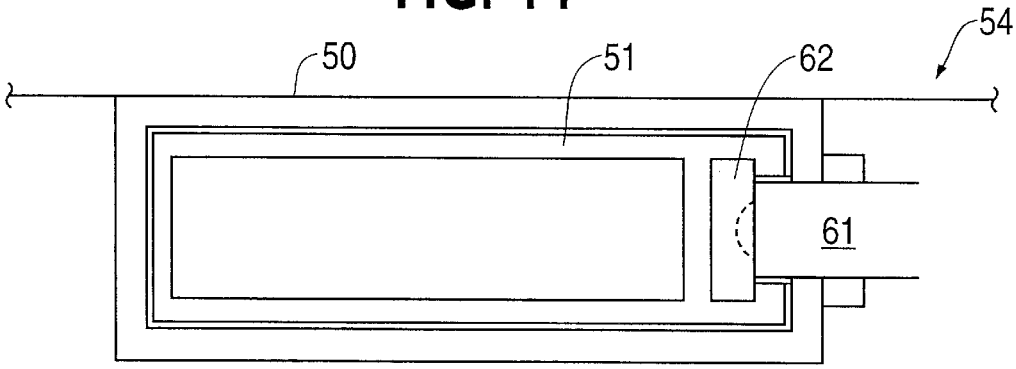
FIG. 11 is a cross-sectional view of the locking mechanism employed to vary the length of the alternate version.

As can best be appreciated by reference to FIGS. 6 and 11, the inboard portion of the inner spreader support arm member 51 is slideably received within the outer spreader support arm member having a retractable stepped shoulder pin element 61 dimensioned to be received in the enlarged aperture 52 in the outer spreader support arm 50 and the reduced diameter apertures 52 in the inner spreader support arm 51 for varying the effective length of each of the horizontal spreader units 12A in a well recognized fashion.

Figure 9:
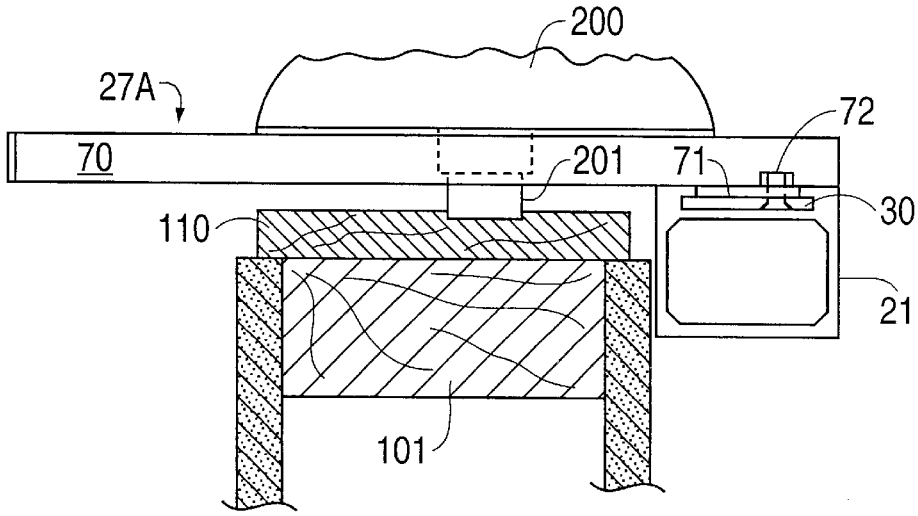
FIG. 9 is a top plan view of an alternate version of the router template guide that can be vertically adjusted on the vertical standards.
Figure 10:
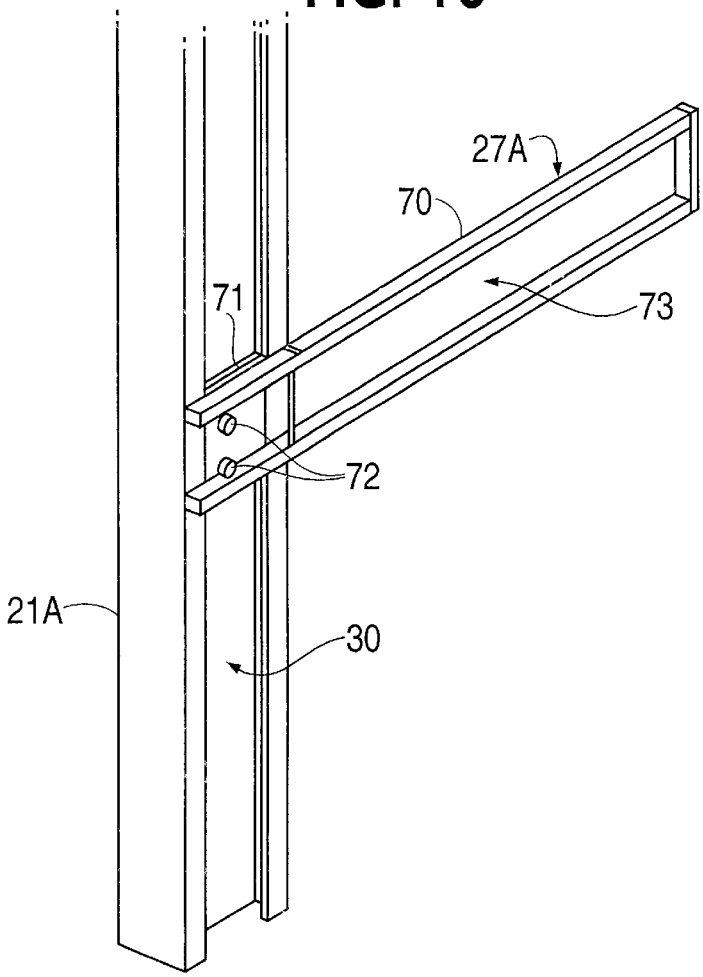
FIG. 10 is a perspective view of the alternate version of the router template guide depicted in FIG. 9.

Turning now to FIGS. 9 and 10, it can be seen that this invention further contemplates a vertically adjustable router template 27A which includes an elongated router template 27A at a desired height relative to one of the vertical standards 21 21', etc. such that the enlarged opening 73 in the framework element 70 of the vertically adjustable router template 27A can be selectively positioned opposite any of the wooden mounting blocks 110 on the vertical studs 101 101' for the purpose of trimming the mounting blocks 110 via the router 200 as explained previously.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A door framing apparatus for installing a finished door frame with a roughed out doorframe having vertical studs wherein the apparatus comprises:

a pair of vertical standard units wherein each vertical standard unit includes an elongated framework member provided with router templates having an enlarged central opening dimensioned to receive a wooden mounting block, and an upper and a lower bearing plate associated with the upper and lower ends of the framework member, at least one of the router templates being vertically adjustable relative to the elongated framework member; and first adjustable means for spacing the vertical standard units a desired distance apart from one another.

2. The apparatus as in claim 1 further comprising second adjustable means for plumbing the vertical units relative to the vertical studs in the roughed out door frame.

3. The apparatus as in claim 2; wherein, each elongated framework member includes a pair of vertical support legs which are connected to one another by said upper and said lower bearing plate.

4. The apparatus as in claim 3; wherein, said second adjustable means comprises a pair of adjustment knobs having threaded stems which are adapted to extend through the upper and lower bearing plates respectively in each vertical standard unit and contact one of the vertical studs in the roughed out door frame.

5. The apparatus as in claim 1; wherein, said first adjustment means comprises a pair of adjustable horizontal spreader units wherein one of the spreader units is operatively associated with the upper bearing plates on the pair of vertical framework members.

6. The apparatus as in claim 4; wherein, said first adjustment means comprises a pair of adjustable horizontal spreader units wherein one of the spreader units is operatively associated with the upper bearing plates on the pair of vertical framework members and the other spreader unit is operatively associated with the lower bearing plates on the pair of vertical framework members.

7. The apparatus as in claim 5; wherein, each of the horizontal spreader units includes a spreader housing member adapted to slidably receive two pairs of spacer arm elements wherein each pair of spacer arm elements extends outwardly from an opposite end of the spreader housing member and are adapted to engage one of the bearing plates on one of the elongated framework members.

8. The apparatus as in claim 6; wherein, each of the horizontal spreader units includes a spreader housing member adapted to slidably receive two pairs of spacer arm elements wherein each pair of spacer arm elements extends outwardly from an opposite end of the spreader housing member and are adapted to engage one of the bearing plates on one of the elongated framework members.

9. The apparatus as in claim 7; wherein, each of the horizontal spreader units are further provided with:

means for captively engaging each pair of spacer arm elements at a desired location relative to the respective ends of the spreader housing member.

10. The apparatus as in claim 8; wherein, each of the horizontal spreader units are further provided with:

means for captively engaging each pair of spacer arm elements at a desired location relative to the respective ends of the spreader housing member.

11. The apparatus as in claim 1; wherein at least one of the router templates is fixedly secured to the respective elongated framework member.

12. The apparatus as in claim 1; wherein, said at least one of the router templates on each elongated framework member is provided with rearwardly extending lip portions that function as a sizing guide for said wooden mounting blocks.

13. The apparatus as in claim 6; wherein, the horizontal spreader units each comprise:

an inner spreader support arm member and an outer spreader support arm member both having inboard ends which are slideably received relative to one another and both having outboard ends which are adapted to engage the bearing plates on each of the vertical standard units.

14. The apparatus as in claim 13 further comprising:

means for adjusting the combined effective length of the inner and outer spreader support arm members.

15. The apparatus as in claim 11; wherein, each elongated framework member is provided with a plurality of router templates that are fixedly secured to the respective elongated framework member.

16. The apparatus as in claim 15 further comprising:

means for adjusting the combined effective length of the inner and outer spreader support arm members.

17. A method for preparing a rough door frame to mount a finished door frame on a plurality of wooden mounting blocks secured to the vertical studs of the rough door frame wherein the method comprises the following steps:

a) adjusting a door framing apparatus having two vertical standard units and a pair of adjustable length horizontal spreader units to coincide with outside dimensions of the finished door frame wherein, each of the vertical standard units is provided with router templates having an enlarged central opening that is dimensioned to fit over said plurality of wooden mounting blocks, at least one of the router template on each of the vertical standard units being vertically adjustable relative to the respective vertical standard unit; and b) positioning the door framing apparatus within said roughed out door frame opening.

18. The method as in claim 17 further comprising the step of:

c) plumbing the two vertical standard units relative to the two vertical studs of the roughed out door frame.

19. The method as in claim 17; wherein, a plurality of vertically spaced router templates are fixedly secured to each of the vertical standard units.

20. A method for preparing a rough door frame to mount a finished door frame on a plurality of wooden mounting blocks secured to the vertical studs of the rough door frame wherein the method comprises the following steps:

a) adjusting a door framing apparatus having two vertical standard units and a pair of adjustable length horizontal spreader units to coincide with outside dimensions of the finished door frame wherein, each of the vertical standard units is provided with at least one router template having an enlarged opening;

b) positioning the door framing apparatus within said roughed out door frame opening;

c) inserting wooden mounting blocks through the enlarged opening in the at least one template and securing the wooden mounting block within the roughed out door frame opening with adhesive;

d) employing a router to trim the wooden mounting blocks disposed within the enlarged opening of the at least one router template on each vertical standard unit; and e) removing the door framing apparatus from within the roughed out door frame opening.

* * * * *